United States Patent [19]

Rabinow

[11] 4,103,570

[45] Aug. 1, 1978

[54] METHOD OF AND APPARATUS FOR MAKING A SHEET METAL ZIG-ZAG KEY

[75] Inventor: Jacob Rabinow, Bethesda, Md.

[73] Assignee: Hall & Myers, Potomac, Md. ; a part interest

[21] Appl. No.: 770,485

[22] Filed: Feb. 22, 1977

[51] Int. Cl.[2] ..... B21D 53/42

[52] U.S. Cl. ..... 76/110; 72/385; 219/153

[58] Field of Search ..... 76/110; 72/342, 382, 72/385; 148/11.5 R, 12 R, 130, 131; 219/149, 153, 154; 70/352, 405, 407, 409; 29/804

[56] References Cited

U.S. PATENT DOCUMENTS

| | | | |
|---|---|---|---|
| 598,469 | 2/1898 | Mouat | 70/407 |
| 1,112,779 | 10/1914 | Forsyth | 219/149 |
| 1,251,578 | 1/1918 | Riecken | 219/149 |
| 1,362,708 | 12/1920 | Lang | 148/131 |
| 1,436,357 | 11/1922 | Reichard | 70/352 |
| 1,900,794 | 3/1933 | Brun | 70/409 |

*Primary Examiner*—Lowell A. Larson

*Attorney, Agent, or Firm*—William D. Hall; Geoffrey R. Myers

[57] ABSTRACT

This invention describes a method of making a sheet metal zig-zag key for a lock. The technique of making a zig-zag key, either as a duplicate of another or in the original form, consists of passing a heavy current through the key so as to get it into a plastic state such as, for example, a red heat, and then deforming it into the desired shape.

9 Claims, 3 Drawing Figures

METHOD OF AND APPARATUS FOR MAKING A SHEET METAL ZIG-ZAG KEY

BACKGROUND OF THE INVENTION

Keys for locks are normally made by stamping or grinding a blank to the correct shape. This, however, is impractical for the duplication of a thin sheet-metal key by a retail store.

This invention has, as one object, the provision of an improved method of making a key from a blank of sheet spring metal.

Another object of the invention is the provision of low-cost, efficient, quick, method of making a key from a blank of thin sheet spring metal.

SUMMARY OF THE INVENTION

According to the invention, a thin blank of spring metal is electrically heated to a plastic condition and then deformed to the desired shape. The extent of the deformation may be controlled by having spacers, and pressure-operated shaping device, for positioning the blank to conform to the shape of a duplicate key held in a position adjacent said blank.

DETAILED DESCRIPTION OF THE DRAWINGS

Figures 1, 2, 3:
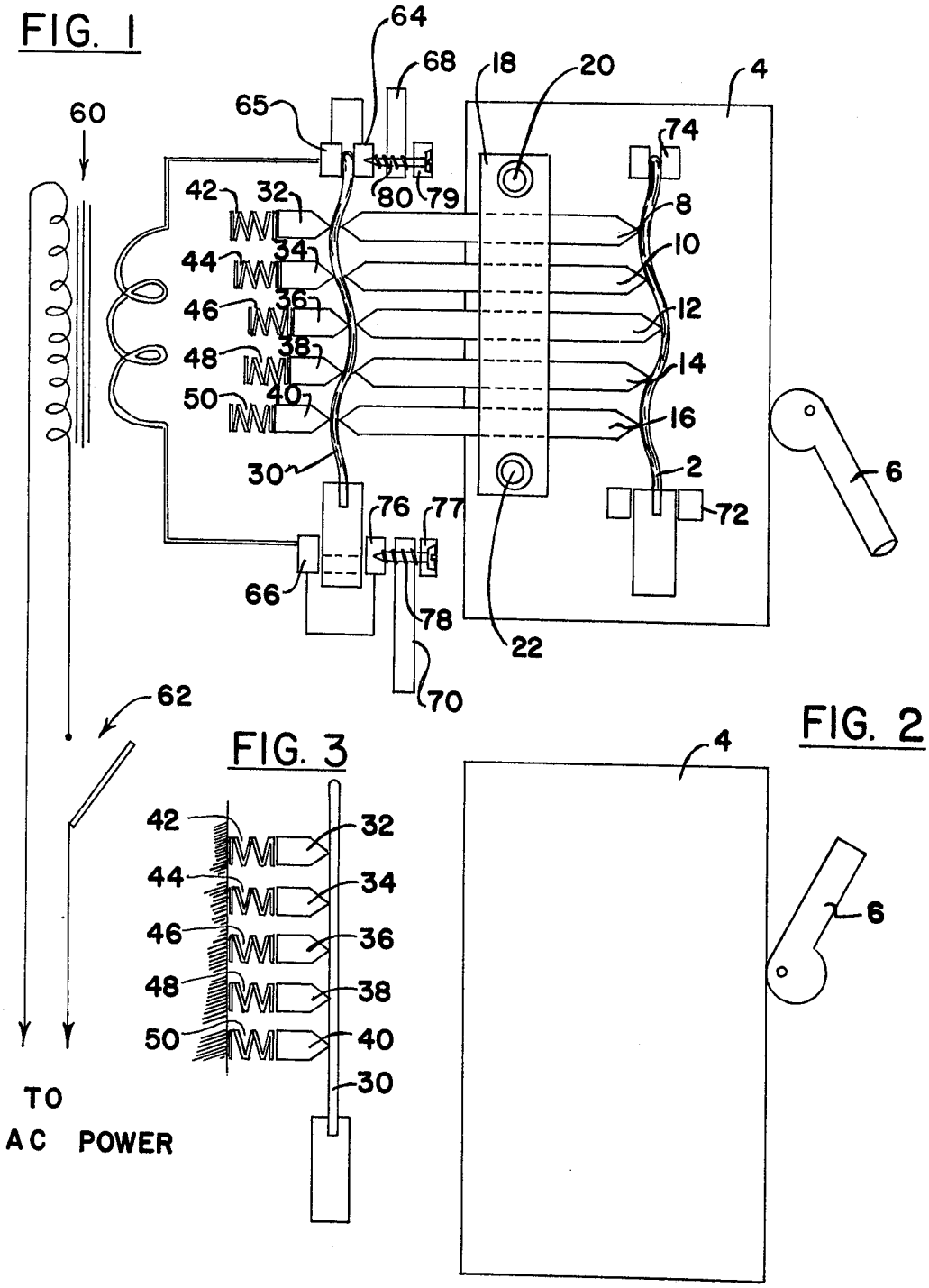
FIG. 1 is a top view of method and apparatus for making a key in accordance with the invention.
FIG. 2 shows a portion of the apparatus in FIG. 1 in an inoperative position.
FIG. 3 is a detail view of a portion of the apparatus.

In FIG. 1, I show one method of manufacturing such a duplicate. The key 2 that is to be copied is mounted on a moving platform 4 on a frame which is not shown. This moving platform 4 can be pushed to the left by a cam-and-lever 6. Against this key 2 are moved steel or ceramic elements 8, 10, 12, 14 and 16 which are then clamped by a plate with knurled screws 20 and 22. This setting of the elements 8 to 16 is done when the plate 4 is to the right as shown in FIG. 2. At this point of time in the process the blank 30, springs 42, 44, 46, 48 and 50, and key-forming elements 32, 34, 36, 38 and 40 are in the position shown in FIG. 3. Moreover, at this point in the process, the virgin or blank key 30 has not yet been formed. Against this key 30 the rather stiff springs 42, 44, 46, 48 and 50 press on the key-forming elements 32 to 40.

The electric current to heat the new key 30 is supplied by a low voltage, high current transformer 60. When it is necessary to shape the key 30, a switch 62 is closed, passing heavy current through the key 30. The blank or virgin key 30 has its ends connected to the terminals 64 and 66 to the secondary of the transformer by clamps 68 and 70. When the current passes through the thin section of the new key 30, the key strip becomes as hot as desired for the forming operation. The lever 6 is swung clockwise, forcing the movable pre-set elements 8 to 16 to press against the blank 30 and form it into the desired shape. The opposing spring driven elements 32 to 40 press the key strip into tight contact with the elements 8 to 16.

Because the current can actually be shut off just before the key is shaped, the elements that press the key can be made of conducting metal, such as steel, but this is not necessary. Either each element can be made of a non-conductor, such as ceramic, or merely the tips of the elements pressing the key 30 can be made of such material. Thus, the elements 8 to 16 can be made of steel, and thus be mechanically rugged while the contacting points can be made non-conducting.

If desired, the switch 62 can be interlocked with the lever 6 so that the whole operation is done with a single motion. Normally, one would like to start the electric current slightly ahead of the pressure but this is not absolutely necessary, since the pressure can be applied to the key 30 while the current is passing. This particular detail of the mechanism would depend on the thickness of the steel, the magnitude of current passed, and the particular details of the design. I show a simple embodiment of the invention; other embodiments can, of course, be constructed.

If the key is to be curved in a transverse direction to its length, as shown in my co-pending patent Application Ser. No. 770,484, filed on even date herewith and entitled PICKPROOF LOCK, the elements that form the key, of course, should be curved accordingly.

The strip from which the key is made will, of course, be shortened in over-all length as the key is formed and, therefore, the contact 64 should be made so that it can move a short distance toward the contact 66 as the key is formed, or the contact should not be so tight as to prevent the metal of the key from sliding through the contact as the key is formed. The handle position of the key, however, has to be held tightly so that the curves in the key are correctly related relative to the handle. This would be for the normal design of the lock and key but not necessarily the only one. The key can be referenced to the forward end, if desired, in which case the clamp 64 should be held very tightly in position, and clamp 66 should be free to move toward it. This depends strictly on the design of the lock and I would normally prefer to keep the handle as the reference for the key.

When an original key is to be made, the options for forming it are many. The key can simply be stamped by rigid dies common to the sheet-metal industry. A device similar to that shown in FIG. 1 can be designed where the elements 8 to 16 are set not by another key but by a set of cams or other mechanisms so as to produce a very wide variety of keys. A locksmith can even set the elements 8 to 16 by hand to create a completely new key, if he so desires.

A first key 2 is mounted upon platform 4 and rigidly affixed to the platform at both its forward and rearward ends by elements 74 that are secured to the platform. The steel or ceramic elements 8, 10, 12, 14, and 16 are slid along grooves on the underside of member 18 until their right-hand ends respectively touch the key 2 at which point bolts 20 and 22 are tightened to rigidly secure the steel or ceramic elements 8, 10, 12, 14, and 16 in their proper places so that they cannot move with respect to the platform 4. It is further apparent that they will move with platform 4.

The handle end of the blank 30 is mounted between supports 66 and 76, the latter of which is movable into key clamping position by rotating the knurled screw head 77 which causes screw 78 to move through fixed support 70 to press element 76 into the handle of the blank 30. The forward end of the blank 30 is mounted between supports 64 and 65. The support 64 is movable toward the support 65 in the same way that support 76 was movable toward support 66; that is, a knurled nut 79 may be rotated to cause screw 80 to move to the left through stationary support 68, pressing element 64 toward element 65 to clamp the forward end of the blank.

The left ends of the springs 42, 44, 46, 48 and 50 are all fixed in position as shown in FIG. 3. Thus, when handle 6 is rotated from the position shown in FIG. 2 to the position shown in FIG. 1, the platform 4 moves to the left and presses the different portions of the blank 30 different distances in accordance with the position of the left-hand ends of the steel or ceramic elements 8, 10, 12, 14, and 16. This is preferably done, however, only after switch 62 has been closed so that step-down transformer 60 passes a very large current through the blank 30, heating it to a plastic state. After the blank has been formed to the correct shape as aforesaid, the switch 62 is opened, the blank 30 is allowed to cool and thus be set, whereupon the handle 6 is rotated to the position of FIG. 2 and the blank 30, which is now a duplicate key, is removed and is ready for use. It is, of course, possible to remove the blank 30 after it has been formed to the correct shape but before it is cooled and to temper it in any suitable way which is appropriate for tempering material devices of the character described.

I claim to have invented:

1. The method of making a key of the type that is used to open a lock, from a blank, that comprises a strip of metal, comprising:

heating said blank, to a plastic state, and converting said blank into a key of the type used to open a lock comprising deforming said blank from a flat plane to give the blank curvature and provide displaced areas at given locations along its length, to give desired displacement to tumblers by said areas.

2. Apparatus for making a blank into a second key that conforms to a first key, said keys being in the form of strips, comprising means for mounting the first key and the blank with faces of the first key and the blank in a generally parallel and spaced relationship, heating means for heating the blank, to a plastic state, and blank-shaping means, including a series of spaced key-shaping devices located between the first key and the blank, for pressing the blank into the shape of said first key.

3. Apparatus as defined in claim 2 in which said heating means comprises means for passing an electric current through said blank to heat the same to a plastic state.

4. Apparatus as defined in claim 2 in which said blank shaping means includes means for moving the blank toward the first key and including means whereby such motion presses the blank against said series of key shaping devices to form the blank into said second key having the shape of the first key.

5. Apparatus as defined in claim 4 in which said "means for mounting the first key and the blank" comprises means for holding the blank at its opposite ends.

6. The method of using a key, of the type that is used to open a lock and which is of the type that is a strip with depressions in its side wall at each of a plurality of given locations, to make a duplicate key from a blank, comprising:

placing the blank in parallel relation with said key, heating said blank to a plastic state, providing a plurality of spacers, with one spacer for each given location respectively with all of said spacers being of the same length; and positioning one end of each such spacer in contact with its complementary given location and the other end of the spacer in contact with the blank.

deforming said blank to conform the heated blank to a configuration which touches said other ends of said spacers, and allowing the blank to cool and become rigid in said configuration to form a key of the type that is used to open a lock.

7. The method of making a key as defined in claim 6 in which said heating step is carried out by passing an electric current through said blank.

8. The method of making a key from a blank as defined in claim 6 which comprises:

supporting said key, of the desired shape, at both ends, said deforming step comprising pressing said blank into said spacers at each one of said given locations.

9. The method of claim 1 in which said blank is supported only at both of its ends during the deforming step, holding a key of the desired shape adjacent to said blank during the deforming step, and effecting the deforming of said blank by pressing a forming device against the blank to provide said depressed areas at positions along the blank complementary to depressed areas of said "key of the desired shape," including using said "key of the desired shape" to position the forming device during the deforming step.

* * * * *